US005141844A

United States Patent [19]

Lau

[11] Patent Number: 5,141,844

[45] Date of Patent: Aug. 25, 1992

[54] POLYMERIC DYE-FORMING COUPLERS

[75] Inventor: Philip T. S. Lau, Rochester, N.Y.

[73] Assignee: Eastman Kodak Company, Rochester, N.Y.

[21] Appl. No.: 519,963

[22] Filed: May 7, 1990

[51] Int. Cl.[5] ..... G03C 7/327

[52] U.S. Cl. ..... 430/548; 430/364; 430/549; 430/553; 430/554; 430/557; 430/565

[58] Field of Search ..... 430/548, 549, 364, 365, 430/565, 553, 554, 557, 359

[56] References Cited

U.S. PATENT DOCUMENTS 2,592,514 4/1952 Harsh ..... 95/2
4,126,461 11/1978 Pupo et al. ..... 96/50
4,128,427 12/1978 Manbaliu et al. ..... 430/552
4,612,278 9/1986 Lau et al. ..... 430/381
5,017,667 5/1991 Cawse et al. ..... 430/548

FOREIGN PATENT DOCUMENTS 0321401 6/1989 European Pat. Off. .
0195643 11/1984 Japan ..... 430/548

*Primary Examiner*—Lee C. Wright
*Attorney, Agent, or Firm*—Joshua G. Levitt

[57] ABSTRACT

Photographic elements are described containing polymeric dye-forming couplers in which the polymer contains coupler moieties that upon reaction with oxidized color developing agent yield dyes of a least two different hues. In one embodiment a neutral dye is formed. In another embodiment a minor proportion of one coupler moiety is used to modify or current the spectral absorption characteristics of another coupler moiety.

6 Claims, 1 Drawing Sheet

POLYMERIC DYE-FORMING COUPLERS

FIELD OF INVENTION

This invention relates to silver halide photographic materials containing novel polymeric dye-forming couplers. In a particular aspect it relates to such materials in which the polymeric dye-forming coupler comprises coupler moieties which yield dyes of at least two different hues.

DESCRIPTION OF THE STATE OF THE ART

It is known that color photographic images can be formed by reaction between oxidized silver halide developing agent and a dye-forming coupler. For example, a coupler of the acylacetanilide or benzoylmethane type generally is used for forming a yellow dye image; a coupler of the pyrazolone, pyrazoloazole, cyanoacetophenone or indazolone type is generally used for forming a magenta dye image; and a phenolic or naphtholic coupler is generally used for forming a cyan dye image.

In many instances where dye-forming couplers are employed to form an image in color photographic materials, the coupler is incorporated in the material prior to exposure. Color development leads to an image in which a dye remains in the location where it is formed. With most such materials the coupler is fixed in place as a result of bulk conferred on it by a ballast group. One such method of conferring bulk on a coupler to cause it remain in place is to incorporate the coupler in a polymer. Lau et al. U.S. Pat. No. 4,612,278 issued Sep. 16, 1986 is an example of a patent to polymeric couplers based on addition polymers and U.S. application Ser. No. 239,909 filed Sep. 1, 1988 in the names of P. T. S. Lau. P. W. Tang and S. C. Cowan is an example of polymeric couplers based on condensation polymers.

U.S. Pat. No. 4,126,461 issued Nov. 21, 1978 described a black and white imaging material that relies on chromogenic coupling to form an image.

It is also known to modify the hue of a principal dye image by association therewith of a coupler which forms a dye of a different hue or color. See U.S. Pat. No. 2,592,514 issued Apr. 8, 1952.

While there is a reference in U.S. Pat. No. 4,612,278 to an optional additional comonomer which can contain a coupler moiety which can be the same or different from the coupler moiety in the principal coupler, prior to my invention there was no recognition in the art that multiple comonomers should be employed in the same polymer and used in such proportions that they provide either a neutral dye image or that they modify the hue of a principal dye in a desired way.

SUMMARY OF THE INVENTION

In accordance with the present invention there is provided a silver halide photographic material having associated therewith a polymeric dye-forming coupler wherein the polymer contains repeating coupler comonomers that form dyes of at least two different hues.

In one embodiment the identity and proportions of the coupler comonomers are such that a neutral or near neutral dye image is obtained upon reaction of the polymeric coupler with oxidized silver halide developing agent.

In a second embodiment the major proportion of the coupler comonomer is based on a single coupler and a minor proportion of the coupler comonomers are provided by one or more other coupler comonomers that form a dye of a hue different from that the major comonomers; the minor comonomers being selected and present in such proportions as to correct for an unwanted absorption of the principal coupler comonomer.

DETAILED DESCRIPTION OF THE INVENTION

Figure 1:
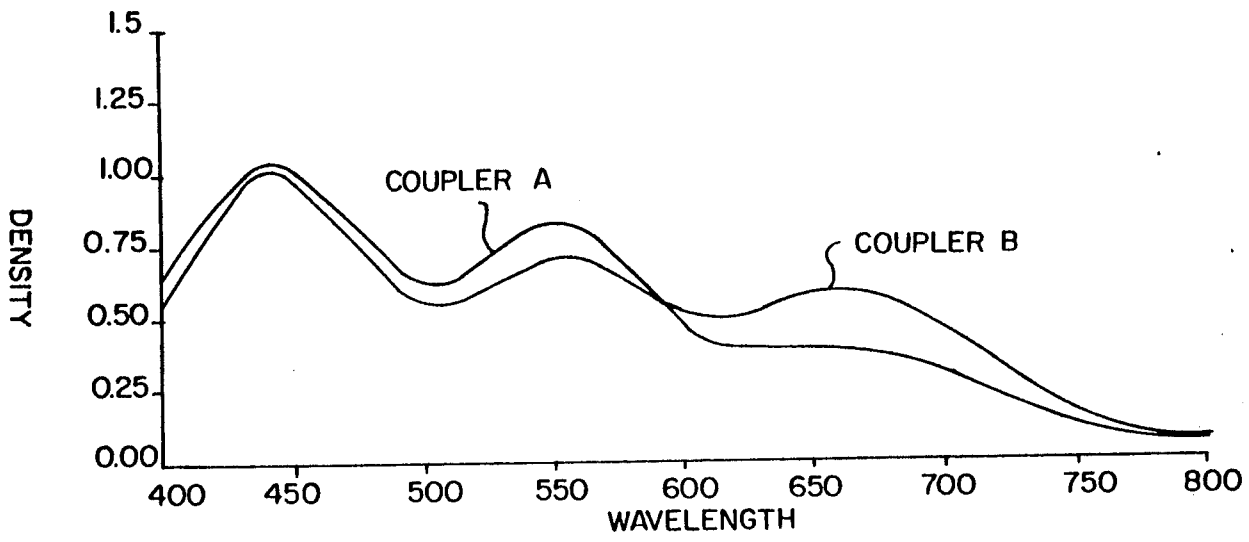

The polymeric couplers of this invention can be based either on addition polymerized polymers or condensation polymers.

In accordance with the first embodiment, it is preferred that the polymer provide a dye of a neutral hue and contain each of a cyan dye-forming coupler comonomer, a magenta dye-forming coupler comonomer, and a yellow dye-forming coupler comonomer. The relative proportions of each of these comonomers will depend on the particular couplers employed, their relative reactivity, the intensity of the dye formed from them and similar considerations. Thus, the exact proportions for any given set comonomers should be determined empirically. I have found that a preferred molar ratio of comonomers is in the range of 90 to 100 parts cyan comonomer to 30 to 100 parts magenta comonomer to 60 to 150 parts yellow comonomer.

In accordance with the second embodiment, it is preferred that the primary coupler comonomer represent at least 80 and preferebly at least 90 mole percent of the coupler comonomers and that one or two additional comonomers be present in such proportion as to correct for unwanted absorptions of the principal coupler comonomer or to add a desired absorption which is lacking in the principal comonomer. In this embodiment it is sometimes preferred that the secondary comonomer absorb in the same general region of the spectrum as does the principal comonomer. For example, the principal comonomer forms a cyan dye then the secondary comonomer can form a cyan dye of a slightly different hue. However, it is within the contemplation of this embodiment to have a principal comonomer which for example forms a magenta dye and have associated in the same polymer with it minor proportions, of a cyan and a yellow dye-forming coupler comonomer.

In addition to the dye-forming coupler comonomers employed in the polymers of this invention, the polymers can contain repeating units which do not contain coupler moieties. Preferred such repeating units for use in addition polymers are the alkoxy alkylacrylates described in U.S. Pat. No. 4,612,278.

Preferred ethylenically unsaturated coupler moieties are illustrated by the following structures:

Cyan Coupler Monomers

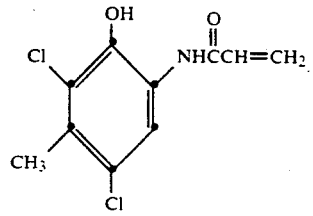

1.

-continued
2.
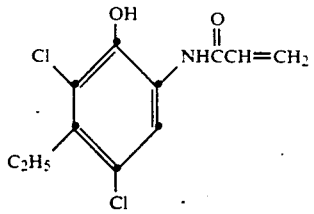
3.
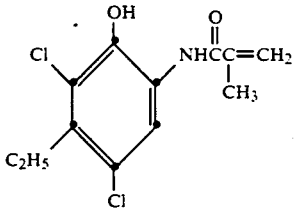
4.
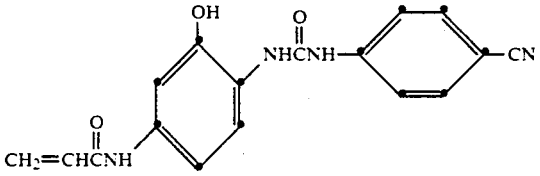
5.
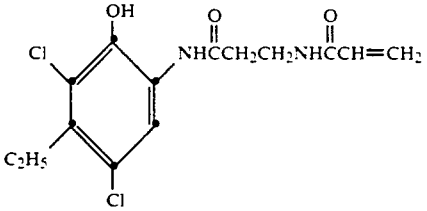
6.
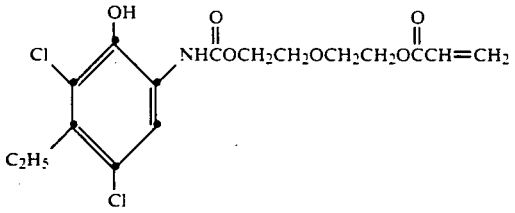
Magenta Coupler Monomers
7.
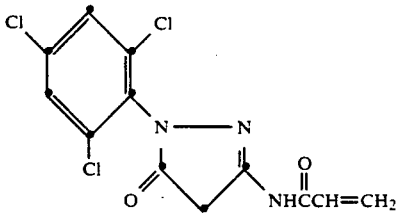
8.
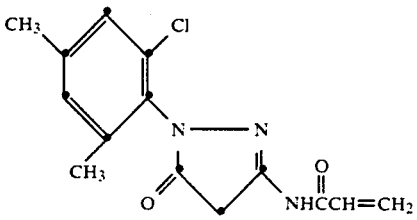
-continued
9.
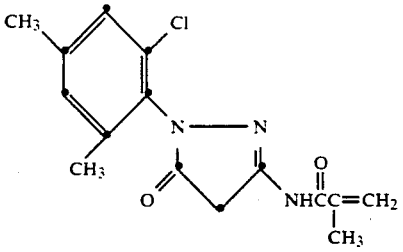
10.
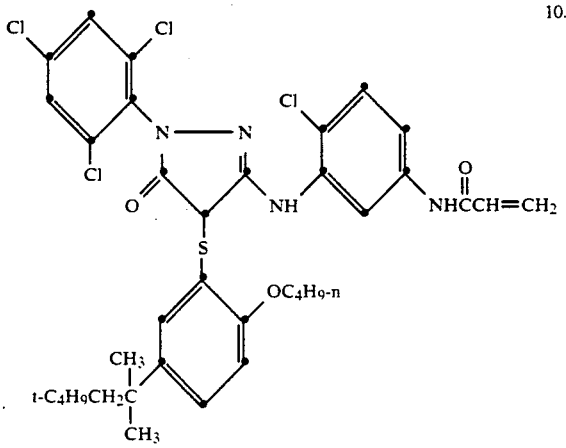
11.
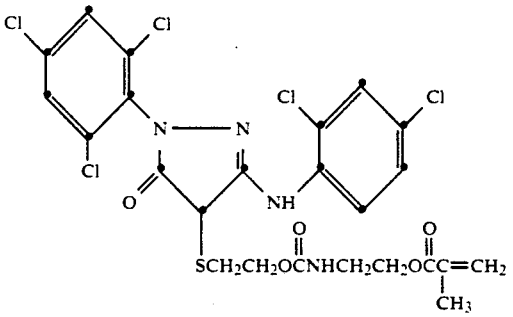
12.
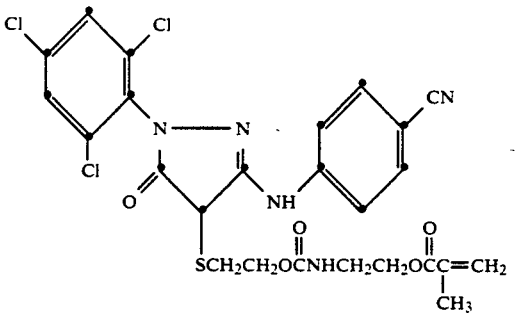
13.
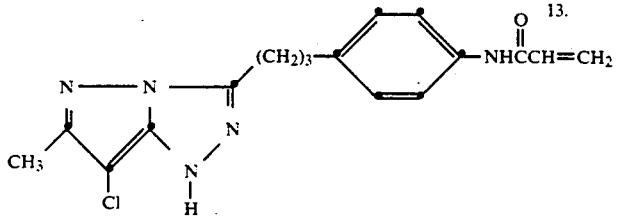

-continued
14.
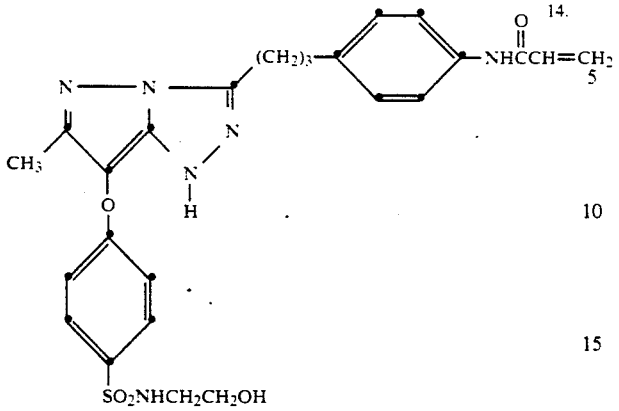
15.
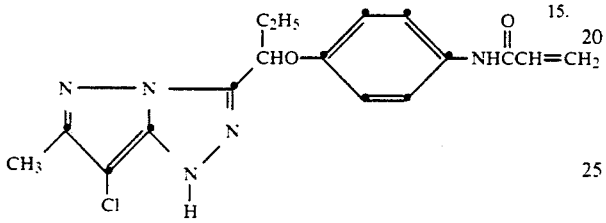
16
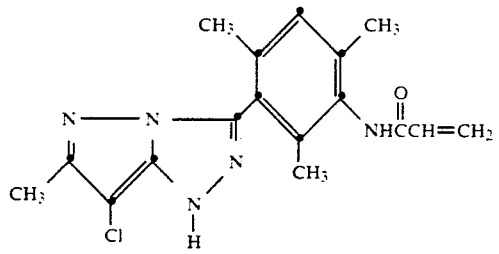
17.
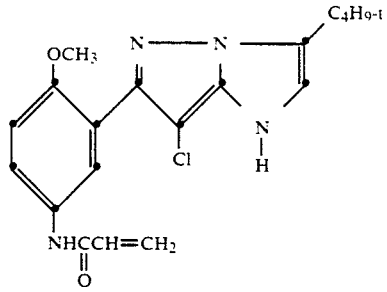
In the structures 18–31, where R appears, it represents H or $CH_3$.
18.
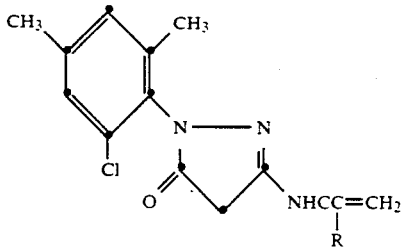
-continued
19.
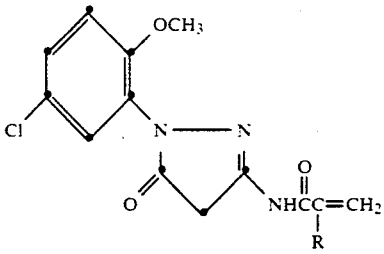
20.
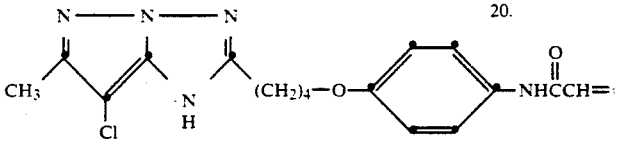
21.
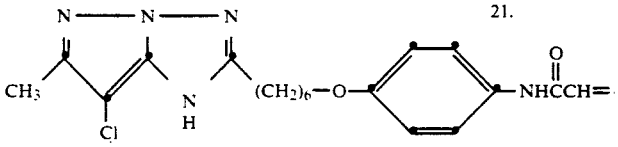
22.
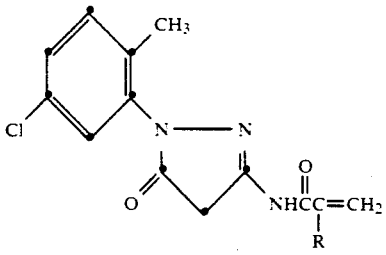
23.
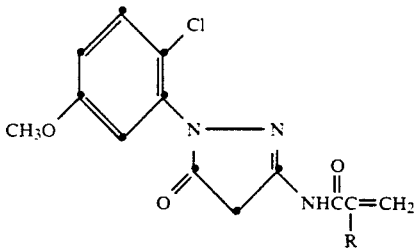
24.
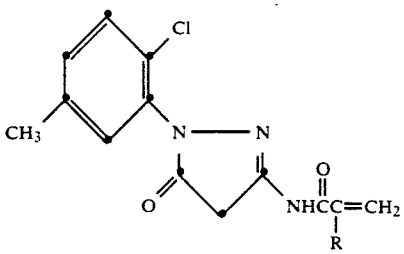
25.
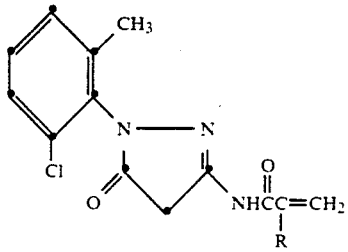

-continued
26.
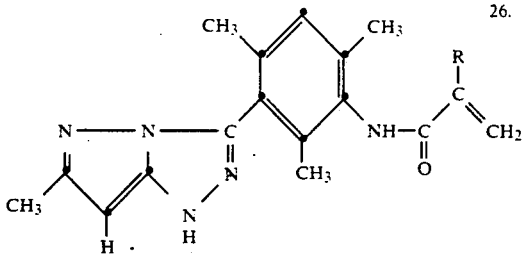
27.
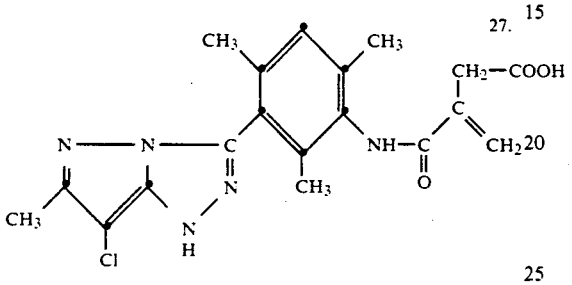
28.
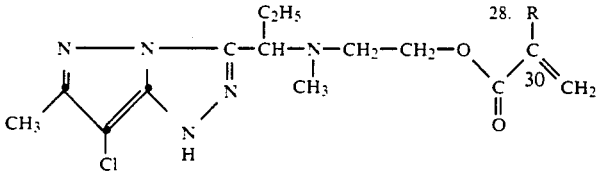
29.
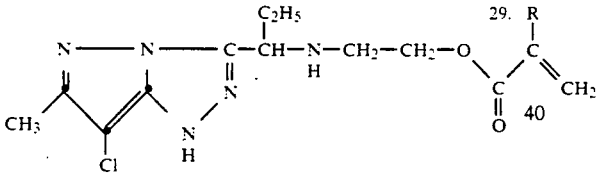
30.
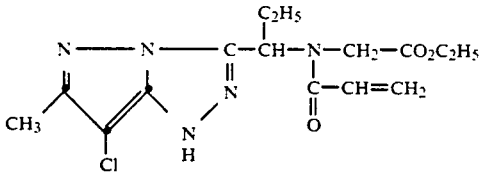
31.
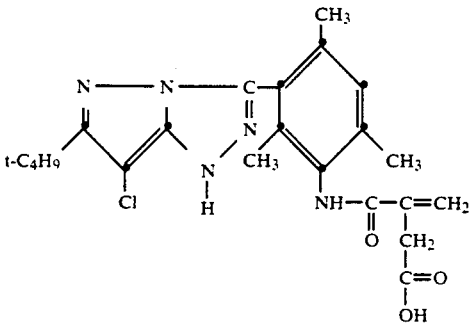
-continued
32.
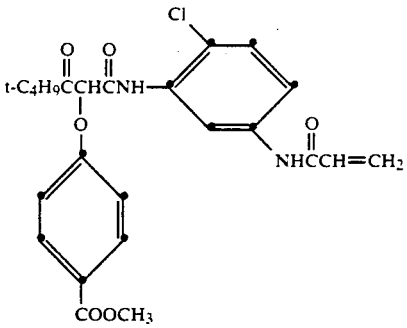
33.
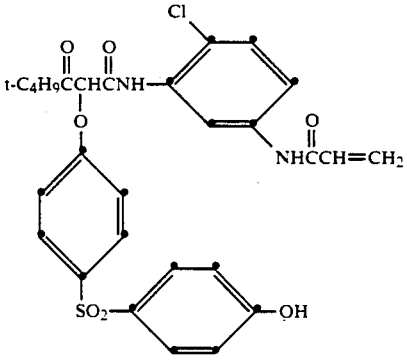
34.
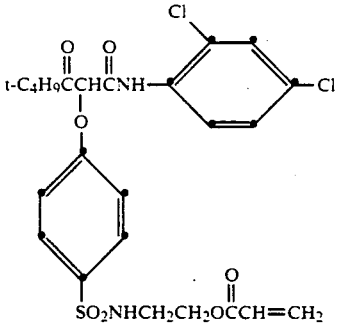
35.
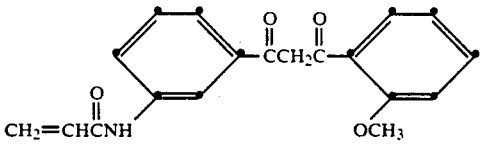
36.
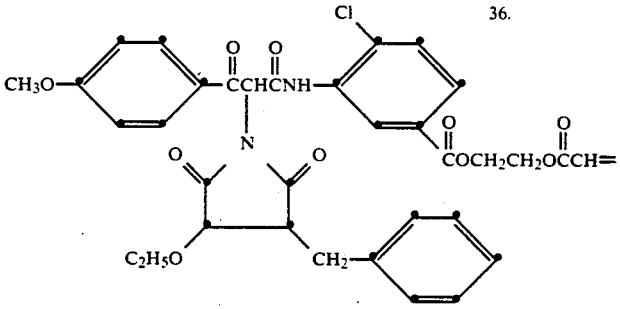
Exemplary condensation polymerizable coupler monomers have the following structures:
Yellow Coupler Monomers 37.
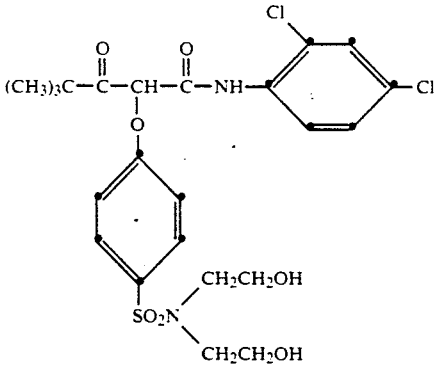
38.
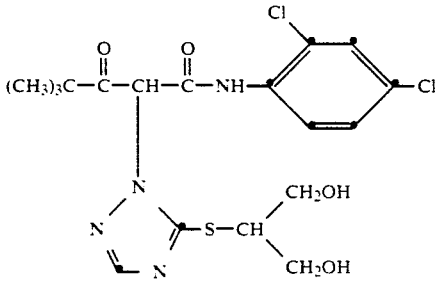
39.
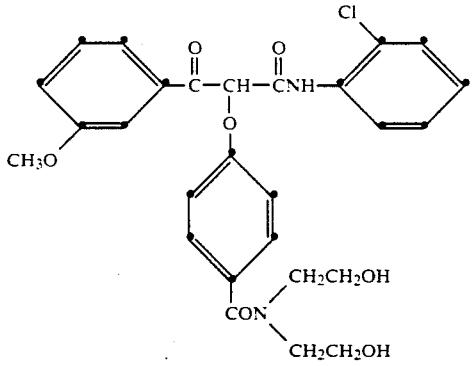
40.
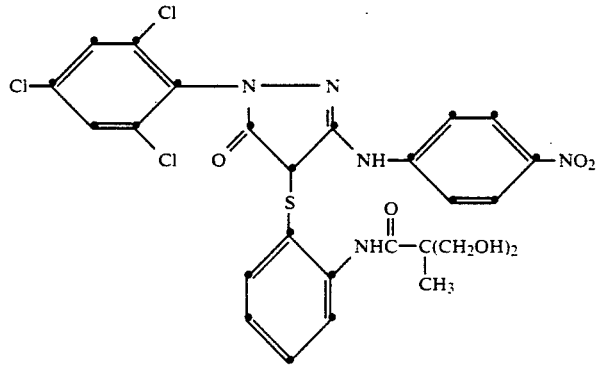

-continued
41.
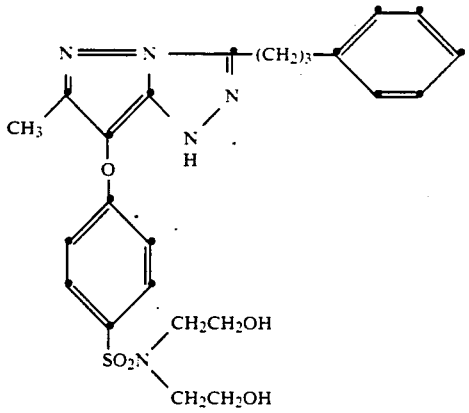
42.
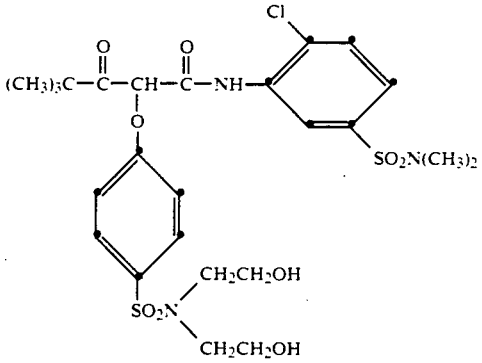
43.
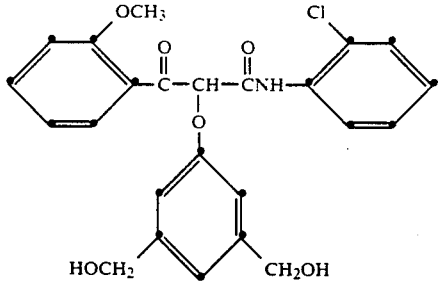
44.
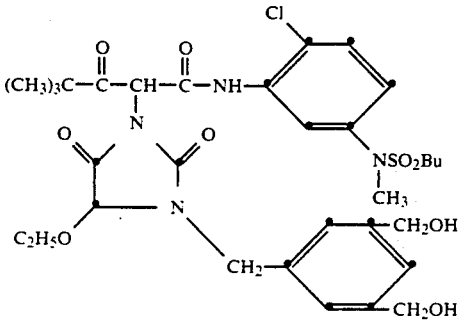

-continued
45.
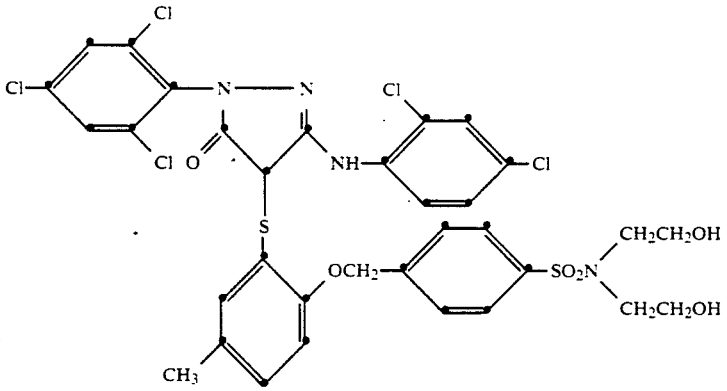
46.
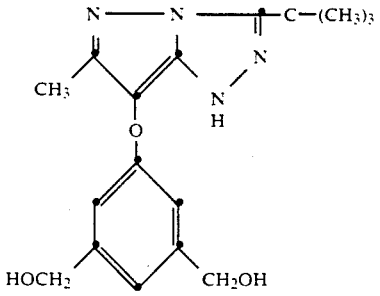
47.
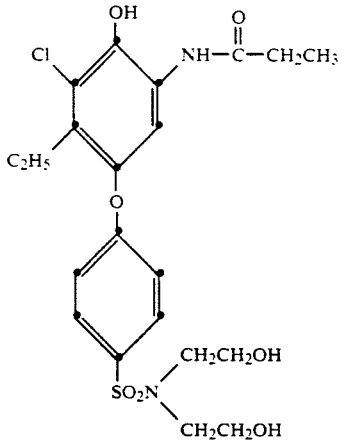
48.
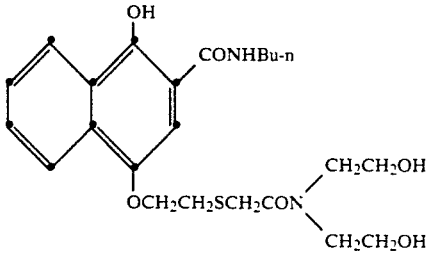

-continued
49.
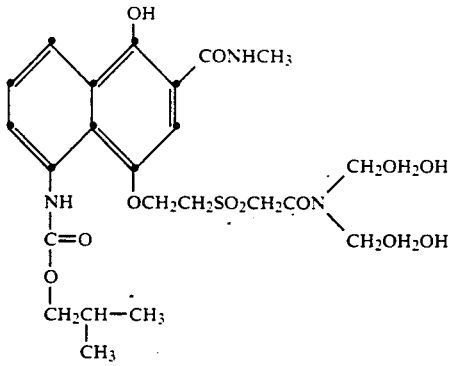
50.
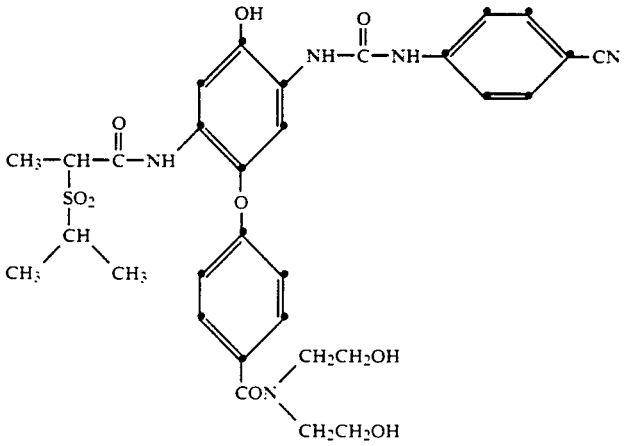
51.
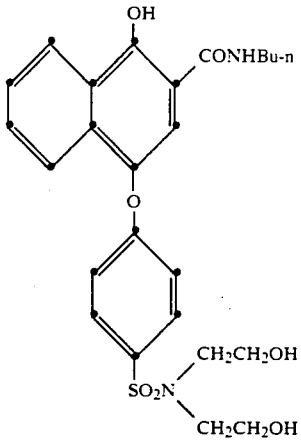
52.
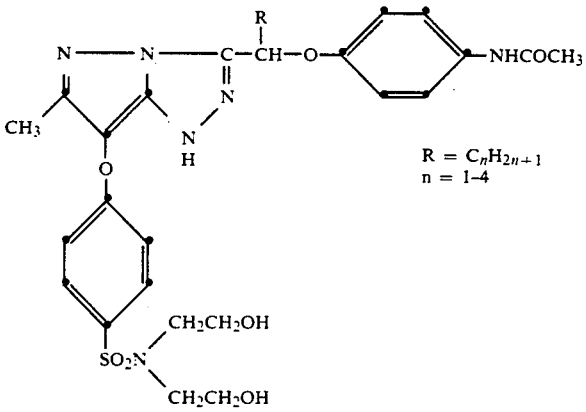
$R = C_nH_{2n+1}$
$n = 1-4$ -continued

53.

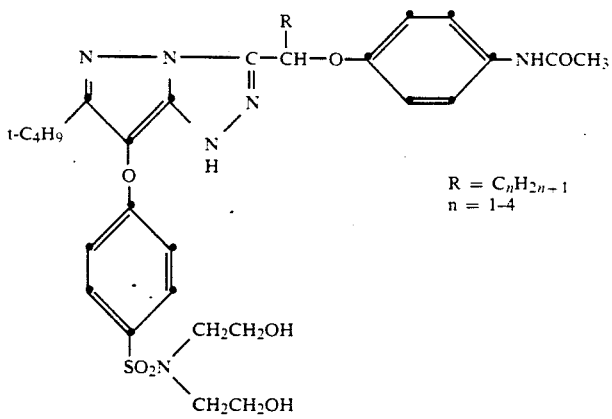

54.

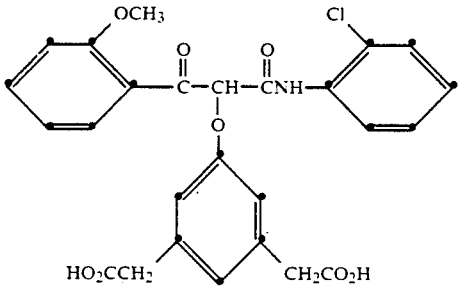

Examples of useful alkoxyalkylacrylate comonomers that can be copolymerized with the vinyl polymers of this invention, include

55. $CH_2{=}CH{-}C{-}O{-}(CH_2)_2{-}O{-}C_2H_5$

56. $CH_2{=}C(CH_3){-}C(=O){-}O{-}(CH_2)_2{-}O{-}C_2H_5$

57. $CH_2{=}CH{-}C(=O){-}O{-}(CH_2)_2{-}O{-}CH_3$

58. $CH_2{=}C(CH_3){-}C(=O){-}O{-}(CH_2)_2{-}O{-}CH_3$

59. $CH_2{=}CH{-}C(=O){-}O{-}(CH_2)_3{-}O{-}C_2H_5$

60. $CH_2{=}C(CH_3){-}C(=O){-}O{-}(CH_2)_3{-}O{-}C_2H_5$

61. $CH_2{=}CH{-}C(=O){-}O{-}(CH_2)_3{-}O{-}CH_3$

62. $CH_2{=}C(CH_3){-}C(=O){-}(CH_2)_3{-}O{-}CH_3$

63. $CH_2{=}CH{-}C(=O){-}O{-}(CH_2)_2O{-}CH_2CH_2CH_3$

64. $CH_2{=}C(CH_3){-}C(=O){-}O{-}(CH_2)_2{-}O{-}CH_2CH_2CH_3$

65. $CH_2{=}CH{-}C(=O){-}O{-}(CH_2)_2{-}O{-}CH_2CH_2OH$

-continued

66. $CH_2{=}C(CH_3){-}C(=O){-}O{-}(CH_2)_3{-}O{-}CH_2CH_2OH$

67. $CH_2{=}CH{-}C(=O){-}O{-}(CH_2)_2{-}O{-}(CH_2)_m{-}O{-}CH_3$ and

68. $CH_2{=}C(CH_3){-}C(=O){-}O{-}(CH_2)_2{-}O{-}(CH_2)_m{-}O{-}CH_3$

Other useful comonomers which can be incorporated in the vinyl polymers, if desired, include the following:

acrylic acid;

methacrylic acid;

acyclic acid esters, such as methyl acrylate, $\beta$-hydroxyethylacrylate, $\beta$-carboethylacrylate and its metallic salts, $\beta$-sulfoethylacrylate and its metallic salts, methyl methacrylate, ethyl acrylate, n-butyl acrylate, t-butyl acrylate, and 2-ethylhexyl acrylate;

acrylic acid amides, such as acrylamide, methacrylamide and mono or disubstituted acrylamide and methacrylamide, such as 2-acrylamido-2-methyl propane sulfonic acid;

vinyl esters, such as vinyl acetate, vinyl propionate, and vinyl laurate;

acrylonitrile;

methacrylonitrile;

aromatic vinyl compounds such as styrene, vinyl toluene, and vinyl acetophenone;

vinylidene chloride;

itaconic acid and itoconic acid monoesters, such as methyl ethyl, propyl and butyl monoesters citraconic acid;

crotonic acid;

maleic acid esters, such as methyl, ethyl, butyl, and aryl esters, such as phenyl esters;

N-vinyl-2-pyrrolidone;

N-vinyl pyridine;

vinyl alkyl ethers, such as methyl, ethyl, butyl, and aryl esters, such as phenyl esters.

The polymeric couplers from this invention can be prepared by known addition polymerization or condensation polymerization procedures. A preferred addition polymerization technique is described in U.S. Patent application Ser. No. 190,801 filed May 6, 1988. Suitable condensation polymerizations are described in U.S. application Ser. No. 239,909 filed Sep. 1, 1988. The disclosures of these applications are incorporated herein by reference.

The polymeric couplers in accordance with the first embodiment of this invention, which yield neutral dyes, can be employed to yield black and white images by chromogenic processing or to provide a neutral dye image as one part of the image in a multicolor photographic element.

Polymeric couplers in accordance with the second embodiment of this invention can be used in the ways and for the purposes that polymeric couplers are known to be used in the art.

In either embodiment, good results are obtained when the polymeric coupler is incorporated in a concentration ranging from about $1\times10^{-4}$ to 0.5 moles of polymeric coupler moiety per mole of silver in the photographic element.

A photographic element in which the polymeric couplers of this invention is incorporated can be a simple element comprising a support and a single silver halide emulsion layer or it can be multilayer, multicolor element. The polymeric couplers of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, other photographic coupler compounds, such as non-polymeric color forming couplers, colored masking couplers, competing couplers, DIR-couplers, DIAR-couplers, and the like. These other photographic coupler compounds can form dyes of the same or different color and hue as the polymeric coupler compounds of this invention. Additionally, the silver halide emulsion layer can contain addenda conventionally contained in such layers.

A typical photographic element of the invention comprises a support having thereon a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith a leat one magenta dye-forming coupler, and a yellow dye image-forming unit comprising at least one blue-sensitive silver halide emulsion layer having associated therewith at least one yellow dye-forming coupler, at least one of the couplers in the element being a polymeric coupler as defined herein. The element can contain additional layers, such as filter layers, interlayers, overcoat layers, subbing layers, and the like.

In the following discussion of suitable materials for use in the emulsions and elements of this invention, reference will be made to *Research Disclosure*, December 1987, Item 17643, published by Kenneth Mason Publications, Dudley Annex, 21a North Street, Emsworth, Hampshire P010 7DQ, England, disclosures of which are incorporated herein by reference. This publication will be identified hereafter by the term "Research Disclosure".

The photographic elements of this invention or individual layers thereof can be chemically sensitized, as described in Section III; contain brighteners, as described in Section V; antifoggants and stabilizers, as described in Section VI; antistain agents and image dye stabilizers, as disclosed in Section VII, Paragraphs I and J; light absorbing and scattering materials, as described in Section VIII; hardeners, as described in Section XI; plasticizers and lubricants, as described in Section XII; antistain agents, as described in Section XIII; matting agents, as described in Section XVI; and development modifiers, as described in Section XXI of the Research Disclosure.

The photographic elements can be coated on a variety of supports as described in Research Disclosure Section XVII and the reference described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Development is followed by the conventional steps of bleaching, fixing, or bleach-fixing, to remove silver and silver halide, washing and drying.

The polymeric couplers prepared by the method according to this invention are useful in combination with other couplers, such as monomeric and/or polymeric couplers known in the photographic art, such as those describes in Research Disclosure Section VII, Paragraphs D, E, F, and G and the publications cited therein.

These couplers can be incorporated in the elements and emulsions as described in Research Disclosure Section VII, Paragraph C, and the publications cited therein.

The following examples are included for further understanding of this invention.

EXAMPLE 1

Preparation of Polymeric Couplers

A series of vinyl addition polymers was prepared for evaluation in which the ratios of the comonomers was varied. The comonomers employed had the following structures:

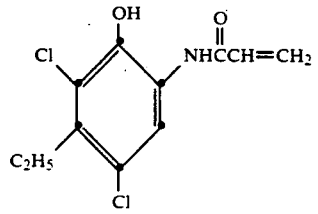

Monomer M

-continued

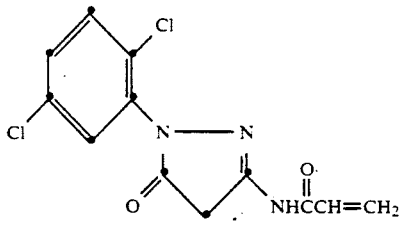

Monomer N

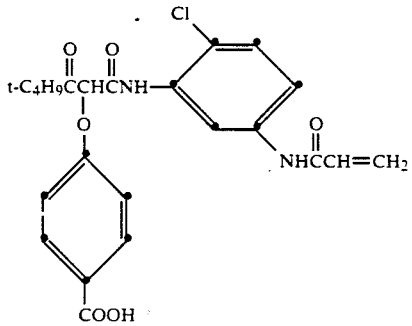

Monomer P

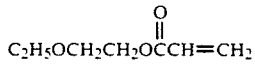

Monomer Q

The polymers had the ratios of comonomers shown in Table I, below.

TABLE I

| Polymer | Polymer Compositions $(M)_m(N)_n(P)_p(Q)_q$ Feed Ratios m | n | p | q | Anal. Ratios (NMR) m | n | p | q | Tg(°C.) |
|---|---|---|---|---|---|---|---|---|---|
| A | 1.0 | 0.5 | 1.0 | 7.5 | | No Data | | | — |
| B | 1.0 | 0.9 | 1.4 | 9.8 | 1.0 | 1.1 | 1.4 | 11.0 | 15 |
| C | 1.0 | 0.5 | 0.7 | 6.6 | 1.0 | 0.3 | 0.6 | 5.5 | 24 |
| D | 1.0 | 0.6 | 0.8 | 7.2 | 1.0 | 0.3 | 0.8 | 6.7 | 24 |

The ratios of the incorporated monomer units were determined by $H^1$NMR* using the integrated ratios of the aromatic protons of the coupling-off group of Monomer P; the —$CH_2$— protons of the ethyl group of Monomer M; the —$COOCH_2$— protons of Monomer Q; and the aromatic protons of the 1-phenyl substituent of Monomer N.

Polymer B, whose preparation is representitive, was prepared as follows:

M+N+P+Q→

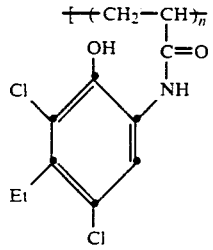

-continued

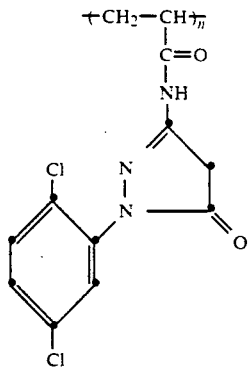

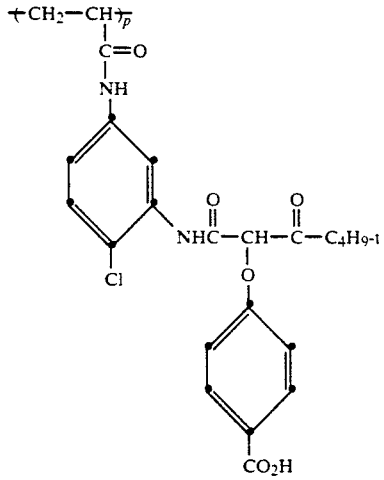

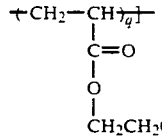

In a 500-ml, 3-necked, round-bottomed flash equipped with a mechanical stirrer, a reflux condenser and a nitrogen inlet tube was placed 350-mL distilled water and 25 mL (0.001 mole) 0.1M surfactant solution (Igepon) and 6.5 mL (0.003 mole) 0.1M initiator solution (sodium azobiscyanovalerate). The mixture was stirred under a blanket of nitrogen in a 90° C. constant temperature water bath. After 15 minutes a solution of 2.86 g (0.011 mole) monomer M, 2.98 g (0.010 mole) monomer M, 6.89 g (0.015 mmol) monomer P, and 15.60 g (0.108 mole) 2-ethoxyethyl acrylate monomer Q dissolved in 20 mL dimethyl sulfoxide and 80 mL ethanol, was added dropwise over a period of 40 minutes. The resulting milky latex was stirred for 15 minutes, then an additional 6.5 mL (0.003 mole) of the above iniator solution was added. The reaction mixture was refluxed for 1.5 hours, during which time most of the ethanol was distilled off and collected in the dropping funnel. Tlc ($CH_2Cl_2$-EtOAc, 1:1) showed that all the starting coupler monomers had reacted. The latex was cooled to room temperature, its pH was adjusted to 7.0 with 1N sodium hydroxide, and it was filtered through a sintered glass funnel to remove any solids that might have precipitated out during the polymerization. The filtered latex was purified by dialysis for three days in running distilled water. A sample was freeze dried for solids content determination and Tg measurement.

Polymers A, C and D were prepared by the same method.

PHOTOGRAPHIC EVALUATION

The following examples further illustrate this invention. In these examples the coating rate, in 5 g/m$^2$ or moles/m$^2$ is shown in parentheses.

EXAMPLE 1

A photographic film was prepared by coating the following layers on a poly(ethylene terephthalate) film support:

| |
|---|
| Gelatin (1.08 g/m$^2$) |
| bis (vinylsulfonylmethyl)ether (hardener) (0.09 g/m$^2$) |
| Gelatin (3.77 g/m$^2$) |
| polymeric coupler (1.5 $\times$ 10$^{-3}$ mole/m$^2$) |
| polydispersed sulfur and gold sensitized-AgBrI (6.5% I) gelatino emulsion |
| Film Support |

The AgBrI gelatino emulsion layer was coated at 0.907 g Ag/m$^2$ for the couplers listed in Table I.

The photographic film was imagewise exposed to a graduated density test object and then processed at a temperature of 40° C. in the following sequence:

| | |
|---|---|
| Color development | 2 min |
| Stop bath | 2 min |
| Water wash | 2 min |
| Bleach | 2 min |
| Water wash | 3 min |
| Fix | 2 min |
| Dry | |

| | |
|---|---|
| Color developer composition | |
| Potassium sulfate | 2.0 g |
| 4-Amino-3-methyl-N-ethyl-N-$\beta$ Methane sulfonamido ethylaniline sulfate | 5.0 g |
| Potassium carbonate (anh.) | 30.0 g |
| Potassium bromide | 1.25 g |
| Potassium iodide | 0.6 g |
| Water to 1 liter | Adjusted to pH 10.0 |
| Stop bath composition | |
| Glacial acetic acid | 30.00 ml |
| Water to 1 liter | |
| Bleach composition | |
| Sodium bromide | 21.5 g |
| Potassium ferricyanide | 100.0 g |
| $NaH_2PO_4.H_2O$ | 0.07 g |
| Water to 1 liter | Adjusted to pH 7.0 |
| Fix composition | |
| $Na_2S_2O_3.10H_2O$ | 250.0 g |
| $NaHSO_3$ | 1.5 g |
| $NaSO_3$ | 6.0 g |
| Water to 1 liter | Adjusted to pH 7.0 |

Figure 2:
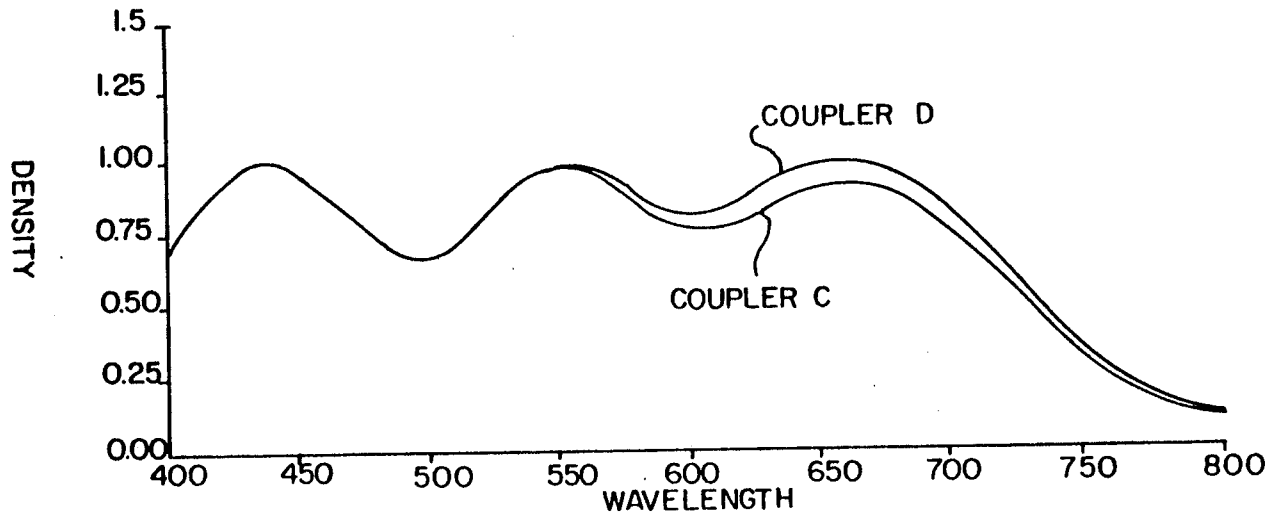

The red, green and blue densities at maximum exposure are recorded in Table II. The spectrophotometric curves, normalized to a maximum dye density of 1.0, are illustrated in FIGS. 1 and 2. The results obtained show that the amount of yellow, magenta and cyan dyes generated from the polymeric couplers can be readily controlled by selectively varying ratios of the yellow, magenta and cyan coupler monomers in the polymer chain. Depending upon the applications desired, it is now possible through our present invention to make polymeric couplers which can provide dyes of all shades and hues, ranging from predominantly one color to a neutral.

TABLE II

| | Density | | |
|---|---|---|---|
| Samples | R | G | B |
| Polymer Coupler A | 1.16 | 1.19 | 1.53 |
| Polymer Coupler B | 1.08 | 1.68 | 1.78 |
| Polymer Coupler C | 0.87 | 0.92 | 1.06 |
| Polymer Coupler D | 1.01 | 0.96 | 1.10 |

The invention has been described in detail with particular reference to preferred embodiments thereof, but it will be understood that variations and modifications can be effected within the spirit and scope of the invention.

What is claimed is:

1. A photographic element, comprising a support, a silver halide emulsion layer and a polymeric dye-forming coupler containing repeating coupler comonomer units that form dyes of at least two different hues, wherein the identity and proportions of the coupler comonomers are such that a neutral dye is obtained upon reaction of the polymeric coupler with oxidized silver halide developing agent.

2. A photographic element of claim 1, wherein the polymeric coupler is an addition polymer.

3. A photographic element of claim 1, wherein the polymeric coupler is a condensation polymer.

4. A photographic element comprising a support, a silver halide emulsion layer and a polymeric dye-forming coupler that upon reaction with oxidizing color developing agent forms a neutral dye, comprising repeating units derived from a cyan dye-forming coupler comonomer, a magenta dye-forming coupler comonomer, and a yellow dye-forming coupler comonomer, the molar ratio of the comonomers being 90 to 100 parts cyan comonomer, 30 to 100 parts magenta comonomer and 60 to 150 parts yellow comonomer.

5. A photographic element of claim 4, wherein the cyan coupler comonomer has the structure

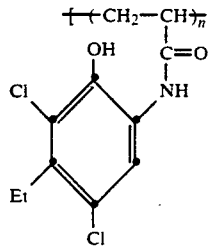

the magenta coupler comonomer has the structure

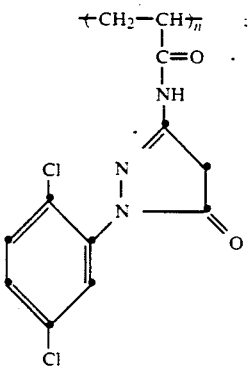
the yellow coupler comonomer has the structure
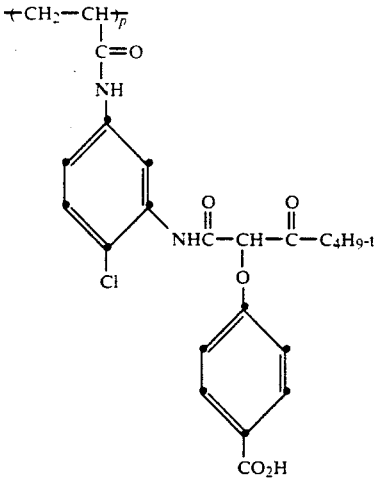
6. A photographic element of claim 5 wherein the molar ratio of the coupler comonomers is 100 parts cyan coupler comonomer, 30 parts magenta coupler comonomer and 80 parts yellow coupler comonomer.
* * * * *